US005346636A

United States Patent [19]

Parc et al.

[11] Patent Number: 5,346,636

[45] Date of Patent: Sep. 13, 1994

[54] COLLOIDAL PRODUCTS CONTAINING BORON AND PHOSPHORUS, THEIR PREPARATION AND THEIR USES AS LUBRICATING ADDITIVES

[75] Inventors: Guy Parc, Rueil Malmaison; Maurice Born, Nanterre, both of France

[73] Assignee: Institute Francais du Petrole, Rueil Malmaison, France

[21] Appl. No.: 953,615

[22] Filed: Sep. 30, 1992

[30] Foreign Application Priority Data

Sep. 30, 1991 [FR] France ..... 91 12096

[51] Int. Cl.[5] ..... C10M 101/02; C10M 159/02

[52] U.S. Cl. ..... 252/49.9; 252/49.8; 252/33.4; 252/18

[58] Field of Search ..... 252/49.8, 49.9

[56] References Cited

U.S. PATENT DOCUMENTS 3,679,584 7/1972 Hellmuth ..... 252/33.4
3,829,381 8/1974 Monroe ..... 252/33.4
4,744,920 5/1988 Fischer et al. ..... 252/33.4
5,080,812 1/1992 Parc et al. ..... 252/18

FOREIGN PATENT DOCUMENTS 2645168 10/1990 France ..... 252/49.8

*Primary Examiner*—José G. Dees
*Assistant Examiner*—Keith MacMillan
*Attorney, Agent, or Firm*—Millen, White, Zelano, & Branigan

[57] ABSTRACT

A colloidal product is provided containing boron and phosphorus obtained by a process comprising:

(1) providing a borated overbased sulfonate selected from the group consisting of a borated overbased alkali metal sulfonate and a borated, overbased alkaline-earth sulfonate;

(2) reacting the borated overbased sulfonate with at least one phosphorus sulfide; and (3) separating the product obtained.

21 Claims, 2 Drawing Sheets

COLLOIDAL PRODUCTS CONTAINING BORON AND PHOSPHORUS, THEIR PREPARATION AND THEIR USES AS LUBRICATING ADDITIVES

BACKGROUND OF THE INVENTION

The present invention is concerned with colloidal products containing boron and phosphorus soluble in mineral oils and obtained by reacting at least one phosphorus sulphide with at least one alkali metal sulfonate or alkaline-earth sulfonate known as an overbased sulfonate, which has first of all been borated.

The present invention is also concerned with the use of these products as additives in mineral and synthetic lubricating bases. In fact, the colloidal compounds according to the invention are excellent anti-wear additives and extreme-pressure additives which can be used in the formulation of engine oils, gearing oils, hydraulic fluids, lubricants for working metals, lubricating fats, and, generally speaking, when a lubrication problem demands a high lubricating capacity combined with excellent thermal stability.

In French Patent No. 2.645.168, a description is given of the preparation of thiophosphorated compounds by the reaction of at least one phosphorus sulfide with at least one detergent additive called an overbased additive. Generally speaking, an overbased detergent additive can be defined as being constituted of a surface-active agent consisting mainly of an alkali salt or alkaline-earth salt of an acid compound containing oleophilic groups, and which, in colloidal dispersion, maintains low mineral acid salts such as $CO_2$, $H_2S$ and alkali or alkaline-earth bases. Furthermore, in that French Patent Application, the reaction product between the phosphorus sulfide and the highly basic detergent additive can be treated subsequently with at least one compound containing active hydrogen which can be water, alcohol, a phenol, an acid, ammonia, an amine, an amide and/or a mercaptan.

SUMMARY OF THE INVENTION

It has now been discovered that it was possible to prepare products having a reduced corrosion-forming capacity on metals, in particular copper, and having extreme-pressure performances which are an improvement over the products described in the earlier French Application 2.645.168.

Their thermal stability is equivalent to that of the products described in this patent application and is very much better than that of organic phosphor-sulfur extreme-pressure additives.

Thus, the products of the invention can be defined as being colloidal products containing boron and phosphorus obtained using a process which comprises:

(1) obtaining an alkali metal sulfonate or borated an overbased alkaline-earth sulfonate;

(2) reacting on said borated overbased sulfonate at least one phosphorus sulfide; and (3) separating the product obtained.

Obtaining overbased sulfonates containing alkali-metal or alkaline-earth borates in step (1) is well-known. The introduction of boron into an overbased sulfonate can be effected either during its production, or by subsequent treatment of an overbased additive by an acid compound containing boron. The first technique, known as co-more basic rendering is described, in particular, in U.S. Pat. No. 3,679,584 and in French Patent No. 2.612.526. The technique of post-treatment of highly basic detergents with boric acid or acid derivatives containing boron is illustrated perfectly by the patents U.S. Pat. Nos. 3,480,548, 3,829,381, 3,907,691, 3,929,650, 4,965,003 and 4,965,004.

The overbased sulfonates which are preferred according to the invention to produce derivatives containing mineral borates are sodium sulfonates or calcium sulfonates which are made more basic with sodium carbonate or calcium carbonate. Their alkali reserve expressed in terms of TBN (equivalent alkalinity expressed in milligrammes of KOH per gram of product) is between 50 and 600 (i.e. between 0.9 and 10.7 basic equivalents per kg) and preferably between 150 and 500 (i.e. between 2.6 and 8.9 basic equivalents per kg).

The preparation of overbased additives is well known and is described in the patents U.S. Pat. Nos. 2,865,956, 3,150,088, 3,537,996, 3,830,739, 3,865,737, 4,148,740 and 4,505,830, for example, and in French Patent 2 101 813. Variants exist for the more-basic-rendering reaction, these variants notably calling for the use of carbonates preformed from alkoxides and $CO_2$ prior to making contact with the alkali salt or earth-alkaline salts of the acid compound; they are described, in particular, in the patents U.S. Pat. Nos. 2,956,018, 3,932,289 and 4,104,180.

The sulfonic acids for the production of overbased sulfonates which can be used according to the invention are known and described in a number of patents, such as in French Patent No. 2 101 813, on pages 5 to 8. The hydrocarbon portion of the molecule advantageously has a molecular mass which is at least equal to 370 in order to ensure miscibility of the corresponding sulfonates in the mineral oils. The acids involved can be "natural" acids which come from the sulfonation of petroleum cuts, or they can be synthetic acids prepared by the sulfonation of charges prepared synthetically: alkenylic hydrocarbons such as polyisobutenes (U.S. Pat. No. 4,159,956), alkylarylic hydrocarbons such as post-dedecylbenzenes, for example, obtained as end products from the production of dodecylbenzene.

The borated acid compounds which can be used in accordance with the invention are boric oxide, boric acids, boric esters in the presence of water. The preferred acid compound is orthoboric acid. The reaction without any added solvent is carried out at between 100° and 175° C. with simultaneous elimination of the water and carbonic anhydride. It is possible to use a protic solvent, preferably methanol. The reaction temperature is then the same as the reflux temperature of the methanol. A particularly advantageous technique consists in using the methanol to extract the solid boric acid contained in a receptacle projecting over the reactor. Another process consists in introducing a saturated solution of boric acid in methanol into the highly basic sulfonate which may have been diluted with a hydrocarbon solvent brought to the reflux temperature of the methanol, with simultaneous evacuation of the methanol vapors.

The amount of borated acid compound used is such that the molar ratio of the boron to the basic equivalent (B.E.) of the overbased sulfonate is between 0.01 and 7, preferably between 0.05 and 3.

In step (2) of the process for the preparation of the products according to the invention, the product from step (1) is reacted with a phosphorus sulfide at a pressure which is between atmospheric pressure and approx. 5 bars absolute (0.5 MPa) at a temperature of between 60° and 200° C., preferably between 90° and 150° C. The reaction between the phosphorus sulfide, solid reagent and the overbased additive is facilitated by thorough agitation of the reactive medium and by the possible use of a hydrocarbon solvent. The phosphorus sulfide can be introduced gradually into the reactive medium, but it can also be introduced all at once at the start of the treatment into the borated overbased compound which may have been dissolved in a hydrocarbon solvent, on condition that the temperature of the reactive medium is less than about 60° C. The reaction is triggered by gradually increasing the temperature within the above-indicated brackets.

The phosphorus sulfides which can be used according to the invention are $P_4S_7$, $P_4S_9$, $P_4S_{10}$. $P_4S_{10}$ is the phosphorus sulfide which is preferred according to the invention. The amount of phosphorus sulfide used is such that the molar ratio of phosphorus to the basic equivalent (B.E.) of highly basic sulfonate is between 0.002 and 0.15 and preferably between 0.02 and 0.12. Beyond the ratio molar P/B.E.=0.15, the reaction between the overbased sulfonate and the phosphorus sulfide risks being incomplete.

During step (2) of the process, a solvent can be used to reduce the viscosity of the medium and to facilitate contact between the various reagents. Examples of solvents according to the invention can be cited as cyclohexane, benzene, toluene, xylenes and generally speaking hydrocarbon cuts which have a boiling range between 60° and 200° C. and preferably between 90° and 150° C.

Step (3) of the process for the preparation of the products of the invention consists in filtering and eliminating the solvent(s) which may be used. Filtration can be effected prior to the solvent being removed, for example on simple cellulose discs, or on layers of filtering agents of the diatomite kind or natural silica of volcanic origin. It is also possible to effect the filtration operation after the solvents are removed. In this case, it is advantageous to carry out the filtration operation under hot conditions, for example between 90° and 120° C. and at a pressure of between 2 and 5 bars, (0.2 to 0.5 MPa).

Distillation of the solvent can be effected in the reactor itself. Elimination of the last traces is facilitated by stripping using nitrogen. It can also be carried out in an evaporator with a thin film.

Complementary additives such as antioxidants, dispersing agents, anti-rust agents, anti-corrosives, anti-foaming agents etc. . . . involved in the formation of packages of additives intended for a specific use can advantageously be introduced during step (3) prior to the solvent being removed.

The kind of products formed by the reaction between the overbased sulfonates which have previously been borated and between the phosphorus sulfides is not known. The additive retains the colloidal state after the reaction according to the invention, and dissolves in the hydrocarbons giving limpid solutions which are perfectly stable during the passage of time.

The dialysis carried out using the method described by AMOS R. and ALBAUGH E. W.: "The determination of additives in lubricants" in "Chromatography in petroleum analyst", published by ALTGELT K. H. and GOW T. H., DEKKER Edit. vol 11, chapter 17, pages 409 to 446 (1979) shows that the phosphorus is found entirely in the fraction which has not been subjected to dialysis which forms the colloidal part and is absent from the product of dialysis where the low molecular mass types are concentrated.

It appears, however, that the constitution of the products according to the invention is surprisingly different from that of the phosphorus sulfide reaction products on the non borated overbased sulfonates such as shown by the nuclear magnetic resonance spectrums of phosphorus which reveal a structure which is clearly less complex in the case of the phosphorus compounds produced when the reagent used for the overbased sulfonates contains alkali borates or alkaline-earth borates (see FIGS. 1A and 1B) . . . .

A relatively small quantity of alkali borates or earth-alkaline borates is sufficient to modify the course of the reaction with phosphorus sulfides.

The colloidal compounds containing boron and phosphorus according to the invention form excellent anti-wear and extreme-pressure additives. The anti-wear and extreme-pressure additives are incorporated into lubricants when these latter are intended to lubricate members subject to significant mechanical stresses, such as with distribution in thermal engines, gears, rolling mechanisms, or abutment members. Significant mechanical stresses also appear with metal machining which involves cutting or shaping operations.

Moreover, the colloidal compounds containing boron and phosphorus according to the invention have very good thermal stability which enables them to be used in lubricants which are used at very high temperatures up to 160° C., such as in some power-injected engines, in very loaded transmissions or with high-speed metal cutting.

The colloidal compounds according to the invention also have more accentuated anti-corrosive properties, and are less odorous than corresponding products which do not contain boron, and this makes it easier for them to be used in the workshop, for example for cutting or shaping metals, without being objectionable for the operating staff.

The corrosion-forming capacity of the colloidal compounds according to the invention is reduced compared with the products described in French Patent Application 2 645 168. It can be further improved, and this is also a part of the invention, by using 2,5-dimercapto-1,3,4-thiadiazole or its derivatives of the formula

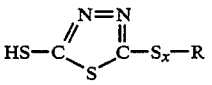

where R=H, with x=1, R=hydrocarbyl or mercapto-thiadiazole group with $1 \leqq x = 5$.

2,5-dimercapto-1,3,4-thiadiazole or its derivatives are preferred according to the invention, these normally being insoluble in the mineral oils but being able to be solubilised in the inorganic colloidal part of the micella. The 2,5-dimercapto-1,3,4-thiadiazole or its derivatives can be added before or after the reaction with the phosphorus sulfide.

The amount of 2,5-dimercapto-1,3,4-thiadiazole or its derivatives used is such that the molar ratio of the group of dimercapto thiadiazole to the phosphorus provided by the phosphorus sulfide is between 0.03 and 3, and preferably between 0.1 and 1. The 2.5-dimercapto-1,3,4-thiadiazole is introduced in the form of powder, and it rapidly dissolves in the reactive medium at a temperature which is above or equal to 90° C. Other compounds such as bi-2,2'(5-mercapto-1,3,4-thiadiazole)disulfide require higher dissolving temperatures which can reach 130° to 140° C.

The 2,5-dimercapto-1,3,4-thiadiazole or its derivatives can be introduced before or after the addition of the phosphorus sulfide in step (2). If done before, there is an opportunity to remove the water initially which has formed due to the reaction with the colloidal carbonate, by azeotropic entrainment, for example.

When the products of the invention are used as additives for lubricating oils or fats, it is possible to incorporate them therewith, for example, in concentrations of between 0.1 and 25% by weight, preferably between 1 and 15% by weight.

The lubricating oils (or fats) also usually contain one or more other additives such as additives which improve the viscosity index, additives which reduce the flow point, anti-oxidants, anti-rust agents, anti-corrosion additives for copper, anti-foaming agents, dispersing agents, friction reducing agents, with which the products of the invention are compatible.

The following examples illustrate the invention. They must not be considered as being limitative in any way. Examples 1, 4 and 8 are given by way of comparison.

EXAMPLE 1

(Comparative)

245 g of a calcium sulfonate which is overbased with calcium carbonate with a TBN of 410 mg KOH/g (i.e. 7.32 basic equivalents per kg) and 250 ml toluene is introduced into an agitated reactor under a cover of nitrogen. When the mixture is homogeneous, 6.4 g 2.5-dimercapto-1,3,4-thiadiazole is introduced and heated to 90° C. until dissolution occurs. The water formed is drawn off by azeotropic distillation, and then once the reaction medium has been brought to 90° C., 18.7 g (0.042 mole) of $P_4S_{10}$ is gradually introduced into the reactor. The temperature is maintained at 90° C. for 2 hours. The reaction medium is then brought to reflux: the temperature stabilizes at 115° C. and is kept at that value for 3 hours. After cooling, the product is filtered on a cellulose disc, and the solvent is then removed from the rotating evaporator. Finally, 270 g of a product is obtained which is of the following elementary analysis:

Ca=14% by weight
P=1.94% by weight
S=4.6% by weight

EXAMPLE 2

245 g calcium sulfonate as used in Example 1, 250 ml toluene and 85 ml methanol is introduced into an agitated reactor provided with a soxhlet device. 23.4 g (0.38 mole) orthoboric acid is placed in the soxhlet cartridge. The reactive mixture is then maintained at reflux until the boric acid completely dissolves. The methanol is then distilled, and the water from the reaction is drawn off by azeotropic distillation. After the reaction medium has cooled, 6.4 g 2,5-dimercapto-1,3,4-thiadiazole is introduced, and, at that stage, the same procedure is followed as that described in Example 1. The yield of the end product is 278 g and contains:

Ca=13.6% by weight
P=1.87% by weight
B=1.47% by weight
S=3.4% by weight

EXAMPLE 3

A borated overbased calcium sulfonate is prepared by carbonatation of a calcium sulfonate derived from a synthetic sulfonic acid according to that stated in Example 1 of the French Patent 2 101 813, except that the hydrocarbon solvent used is toluene instead of hexane, and the TBN noted is 400. After passage of the carbonic anhydride, the boric acid is added to the reaction medium in such a way that the molar ratio of the boron to the basic equivalent is 0.45 and the mixture is brought to reflux until the reaction is complete. The solvents and the water formed during the preceding reactions are removed by distillation. After filtration under hot conditions, the product obtained has the following characteristics:

Ca=13.7% by weight
S=3.35% by weight
TBN (ASTM D2896)=362 mg KOH/g (that is to say 6.46 basic equivalents per kg).

250 g of this borated sulfonate is dissolved in 250 ml toluene. 6.5 g of 2,5-dimercapto-1,3,4-thiadiazole is then added, and then dissolved by heating to 90° C. The water formed is drawn off by azeotropic distillation, and then once the reactive medium has been brought to 90° C., 19.1 g (0.043 mole) of $P_4S_{10}$ is gradually introduced into the reactor. At this stage, the same mode of operation is followed as that described in Example 1, except that 100 g neutral oil 100 is added before the solvent is removed. Finally, 369 g of product is obtained of the following composition:

Ca=9.31% by weight
P=1.44% by weight
B=2.23% by weight
S=2.5% by weight

EXAMPLE 4

(Comparative)

245 g overbased calcium sulfonate used in Example 1 and 250 ml xylene is introduced into an agitated reactor and under a cover of nitrogen. After it has become homogeneous the mixture is brought to 90° C. and 10.9 g (0.025 mole) of $P_4S_{10}$ is gradually introduced. After 5 hours of reaction at 90° C. and cooling, 3.7 g of 2.5-dimercapto-1,3,4-thiadiazole is introduced and the mixture is once again heated to 90° C. After the mixture is dissolved it is brought to reflux. The temperature stabilizes at 143° C.; it is kept at that value for 2 hours. After filtration and removal of the solvents, 251 g of product is collected which has the following analysis:

Ca=15.0% by weight
P=1.21% by weight
S=3.4% by weight

EXAMPLE 5

The same amounts of reagents and the same procedure as in Example 4 are used, but an initial treatment is carried out with 23.4 g (0.38 mole) of orthoboric acid using the technique described in Example 2. 264 g of end product is yielded, the basic analysis of which is as follows:

Ca=14.3% by weight
P=1.15% by weight
B=1.55% by weight
S=2.3% by weight

EXAMPLE 6

The procedure used is the same as in Example 2, but with a overbased calcium sulfonate with a TBN of 483 mg KOH/g (8.62 basic equivalents per kg) and with the following quantities of reagents:
overbased calcium sulfonate=250 g
orthoboric acid=59.9 g
2.5-dimercapto-1,3,4-thiadiazole=4.2 g
$P_4S_{10}$=12.6 g Finally, 289.9 g of product is obtained of the following composition:
Ca=15.7% by weight
P=1.19% by weight
B=3.55% by weight
S=2.4% by weight

EXAMPLE 7

The same amounts of reagent and the same procedure as those indicated in Example 5 are used, except that the 2,5-dimercapto-1,3,4-thiadiazole is replaced by an equivalent amount of bi 2,2'(2,5-dimercapto-1,3,4-thiadiazole) disulfide. Finally, after filtration and evaporation of the solvents, 267 g of product is recovered which is of the following composition:
Ca=14.3% by weight
P=1.14% by weight
B=1.55% by weight
S=2.8% by weight

EXAMPLE 8

(Comparative)

250 g calcium sulfonate as used in example 1 and 250 ml toluene is introduced into an agitated reactor under a cover of nitrogen. After it has become homogeneous, the mixture is brought to 110° C., and 26.7 g (0.06 mole) of $P_4S_{10}$ is then gradually introduced and the reaction is continued until the sulfurated hydrogen stops being released. After filtration and evaporation of the toluene, 267 g of a product is obtained of the following composition:
Ca=14.4% by weight
P=2.76% by weight
S=5.5% by weight

EXAMPLE 9

The same procedure is followed as in Example 8 hereinabove after a treatment has been initially carried out with 22.6 g (0.37 mole) of orthoboric acid using the technique described in Example 2. After the usual treatments, 278 g of product is recovered which is of the following analysis:
Ca=13.9% by weight
P=2.53% by weight
B=1.42% by weight
S=2.9% by weight

EXAMPLE 10

Evaluation of Thermal Stability

The product of Example 5 is used to formulate a 75 W-80 W manual transmission oil in accordance with the specification PEUGEOT-CITROEN B71 2315 and which is of the following composition (Formulation A):
Product from Example 5=9.6%
Flow point additive (Plexol ® 156)=0.3%
Viscosity additive (Plexol ® 1019)=9.2%
neutral oil 130=80.9%
anti-foaming silicon=40 ppm The behaviour of this oil in terms of thermal stability is compared with that of a commercial lubricant containing a conventional phospho-sulfurised additive (formulation B) which corresponds to the same specification, in the GFC TO21 A90 test which is intended to verify the stability of transmission lubricants. The test is carried out at 150° C. For 192 hours with a flow of air at 10 litres/hour.

The insoluble products at the end of the test are determined using the GFC T022 A90 method. The following results were obtained:

TABLE 1

| Deposits | Products: Product of Ex. 5 | Products: Commercial Lubricant |
|---|---|---|
| insoluble suspension | 0.1% mass | 1.64% mass |
| insoluble deposits | nil | 3.58% mass |
| insoluble totals | 0.1% mass | 5.22% mass |

It appears that the lubricant formulated on the basis of the product in Example 5 has a better thermal stability than the commercial lubricant.

EXAMPLE 11

Evaluation of Anti-Corrosive Properties in Relation to Copper.

The tests for the corrosion of copper are carried out in accordance with the AFNOR M 07-015 method which is equivalent to the ASTM D130 method, for 3 hours at temperatures of 100°, 121° and 150° C.:

TABLE 2

Tests for the Corrosion of Copper

| Products | Temperature 100° C. | Temperature 121° C. | Temperature 150° C. |
|---|---|---|---|
| Product of Example 1* | 1 a | 2 b | 4 d |
| Product of Example 2 | 1 a | 1 b | 3 b |
| Product of Example 3 | 1 a | 1 b | 3 a |
| Product of Example 4* | 2 b | 2 c | 4 a |
| Product of Example 5 | 1 a | 1 b | 2 b |
| Product of Example 6 | 1 a | 1 b | 1 b |

*comparison

Corrosion of the copper is less pronounced with the additives containing boron, the difference being particularly accentuated for the tests carried out at 150° C.

EXAMPLE 12

Evaluation of the Extreme-Pressure Properties

The products according to the invention are evaluated in terms of their extreme-pressure properties in a lubricating oil. The mineral oil used is a 130 neutral oil which has the following characteristics:
kinematic viscosity at 40° C.=25.5 $mm^2/s$
kinematic viscosity at 100° C.=4.7 $mm^2/s$
viscosity index=101
flow point=−15° C.
Sulfur content=0.46% en masse The additives are added to the 130 neutral oil in a concentration such that the phosphorus content of the mixtures is identical and equal to 0.11%.

The tests are carried out on a 4 ball machine in accordance with the PEUGEOT-RENAULT D55 1136 method, in which the gripping charge is determined on the basis of tests lasting one minute. The results are given in the following table:

TABLE 3

PEUGEOT-RENAULT D55 1136 Gripping Tests

| Products | B % mass in oil | Charge before gripping (N) | Imprint Diameter mm |
|---|---|---|---|
| Product of Ex. 1 | 0 | 600 | 0.40 |
| Product of Ex. 2 | 0.08 | 900 | 0.46 |
| Product of Ex. 3 | 0.18 | 1000 | 0.49 |
| Product of Ex. 4 | 0 | 700 | 0.40 |
| Product of Ex. 5 | 0.15 | 900 | 0.45 |
| Product of Ex. 6 | 0.33 | 1200 | 0.49 |
| Product of Ex. 7 | 0.15 | 1000 | 0.42 |

The presence of boron significantly improves the anti-gripping properties. The better result is obtained with the product which has the highest boron content. The PEUGEOT-CITROEN B71 2315 specification fixes a maximum ball imprint at 0.5 mm for a load of 1000N. The table given shows that only the products containing boron according to the invention are capable of attaining this level of performance.

EXAMPLE 13

Examination by Nuclear Magnetic Resonance of the Phosphorus.

The products in Examples 8 and 9 are examined by NMR $^{31}$p on a CXP 200 Brüker apparatus, in solution in the deuterised benzene at ambient temperature and at a frequency of 81 MHz.

The P/BE molar ratio is identical for both products and is equal to 0.125. For the sulfonate which has been treated previously with orthoboric acid (Example 9), the B/BE molar ratio is equal to 0.2.

Figure 1A:
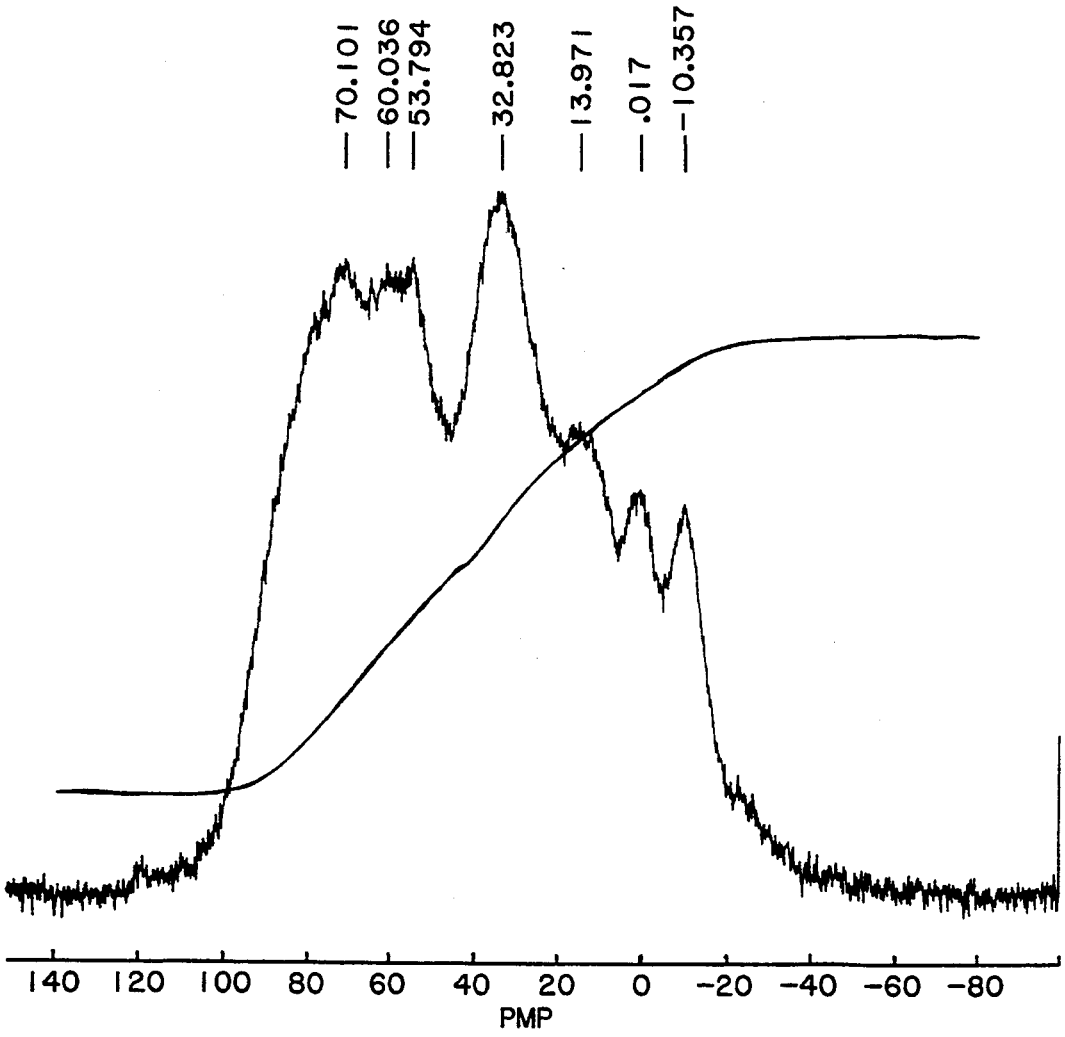
FIGS. 1A and 1B show the spectrums for the products in Examples 8 and 9 respectively.
Figure 1B:
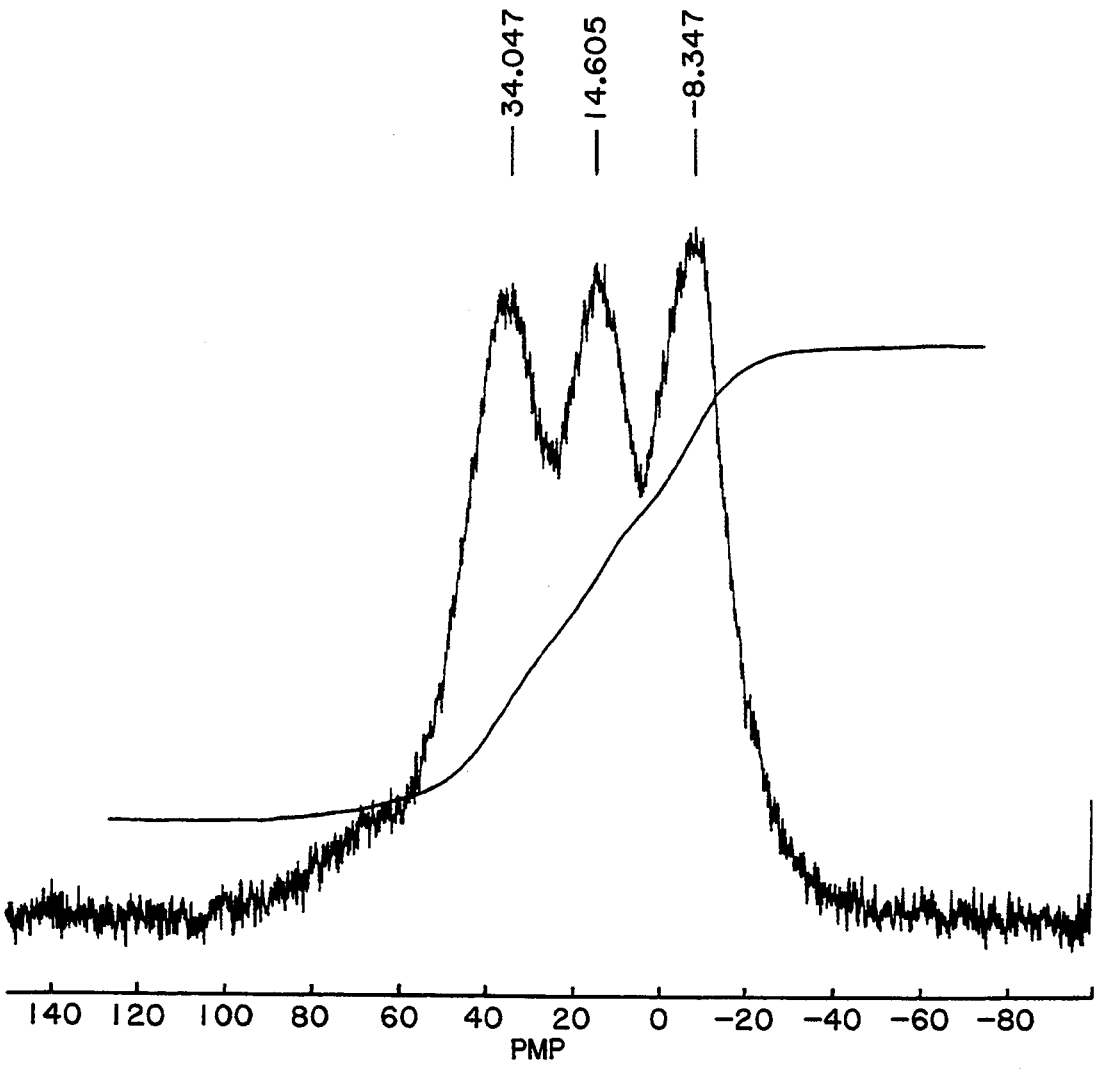

Despite the fact that they are obtained with products in solution, the general trend of the spectrums recalls that obtained in NMR of the solid which confirms that in this type of product, the phosphorus is well localised in the mineral micella. The general trend of the spectrums obtained with and without boron differs greatly. When boron is present, no more bands are noted beyond +50 ppm, a region which seems to correspond to the phospho-sulfurated compounds which have a high sulfur content.

We claim:

1. A colloidal product containing boron and phosphorus obtained by a process comprising:

(1) providing a borated overbased sulfonate selected from the group consisting of a overbased alkali metal sulfonate and a borated overbased, highly basic alkaline-earth sulfonate;

(2) reacting said overbased sulfonate with at least one phosphorus sulfide; and (3) separating the product obtained.

2. A product according to claim 1, wherein step (1) is carried out by reacting at least one acid compound containing boron during production of the overbased sulfonate.

3. A product according to claim 1, wherein step (1) is carried out by post-treating an overbased sulfonate with at least one acid compound containing boron.

4. A product according to claim 2, wherein said acid compound containing boron is boron oxide, a boric acid or a boric ester used in the presence of water.

5. A product according to claim 3, wherein said overbased sulfonate is a sodium sulfonate or a calcium sulfonate made more basic with calcium carbonate or sodium carbonate, and has a TBN of 50 to 600.

6. A product according to claim 2, wherein in step (1) the operation is effected without solvent at a temperature of between 100° and 175°.

7. A product according to claim 2, wherein in step (1), the operation is effected in a protic solvent at the reflux temperature thereof.

8. A product according to claim 2, wherein in step (1) the acid compound containing boron is used in a molar proportion of 0.01/1 to 7/1 in relation to the basic equivalent of the overbased sulfonate.

9. A product according to claim 1, wherein the reaction in step (2) is effected at a pressure of 1 to 5 bars, at a temperature of between 60° and 200° C. and with a molar proportion of phosphorus sulfide of 0.002/1 to 0.15/1 in relation to the basic equivalent of the highly basic sulfonate.

10. A product according to claim 1, wherein the reaction in step (2) is effected in a hydrocarbon solvent.

11. A product according to claim 1, wherein in step (3) filtration is effected and the solvent is removed.

12. A product according to claim 1, wherein a 2,5-dimercapto-1,3,4-thiadiazole is added before immediately step (2), in a molar proportion of 0.03 to 3 dimercaptothiadiazole groups per atom-gramme of phosphorus used.

13. A lubricating oil or fat containing a product according to claim 1 as an additive.

14. A lubricating oil or fat containing a product according to claim 13, in which said product is incorporated into the lubricating oil or fat in a concentration of 0.1 to 25% by weight.

15. A product according to claim 3, wherein said acid compound containing boron is boron oxide, a boric acid, or a boric ester used in the presence of water.

16. A product according to claim 3, wherein overbased sulfonate is a sodium sulfonate or a calcium sulfonate made more basic with calcium carbonate or sodium carbonate and has a TBN of 50 to 600.

17. A product according to claim 3, wherein in step (1), the operation is effected without solvent at a temperature of between 100°–175° C.

18. A product according to claim 3, wherein in step (1), the operation is conducted in a protic solvent at the reflux temperature thereof.

19. A product according to claim 3, wherein in step (1), the acid compound containing boron is used in a molar proportion of 0.01/1 to 7/1 in relation to the basic equivalent of the overbased sulfonate.

20. A product according to claim 1, wherein a 2,5-dimercapto-1,3,4-thiadiazole is added immediately after step (2) in a molar proportion of 0.03 to 3 dimercaptothiadiazole groups per atom-gram of phosphorus used.

21. A product according to claim 14, comprising a lubricating oil containing about 0.18–0.33% by weight of boron in the oil.

* * * * *

UNITED STATES PATENT AND TRADEMARK OFFICE

CERTIFICATE OF CORRECTION

PATENT NO. : 5,346,636

DATED : September 13, 1994

INVENTOR(S) : Guy PARE et al.

It is certified that error appears in the above-indentified patent and that said Letters Patent is hereby corrected as shown below:

Claim 1, column 9, line 56: After "a" insert --borated--.

Claim 1, column 9, line 57: After "overbased", delete "highly basic".

Claim 9, column 10, line 25: After "the", delete "highly basic" and insert --overbased--.

Claim 11, column 10, line 29: After "claim" delete "1" and replace with --10--.

Signed and Sealed this

Twenty-ninth Day of November, 1994

*Attest:*

*Attesting Officer*

BRUCE LEHMAN

*Commissioner of Patents and Trademarks*